US005759108A

United States Patent [19]

Heddon

[11] Patent Number: 5,759,108

[45] Date of Patent: Jun. 2, 1998

[54] BOWLING ALLEY PINSETTER AND METHOD FOR HANDLING SPENT BALLS AND PINS

[76] Inventor: Will Heddon, 640 Alternate 27, P.O. Box 628, Lake Hamilton, Fla. 33851

[21] Appl. No.: 668,107

[22] Filed: Jun. 21, 1996

[51] Int. Cl.[6] ..... A63D 5/02

[52] U.S. Cl. ..... 473/73; 473/98; 473/106

[58] Field of Search ..... 473/73, 87–91, 473/93, 94, 98, 99, 106, 110, 111, 114

[56] References Cited

U.S. PATENT DOCUMENTS

| | | | |
|---|---|---|---|
| 1,573,643 | 12/1926 | Proch | 473/87 |
| 2,247,788 | 7/1941 | Schmidt . | |
| 2,600,918 | 6/1952 | Pohl . | |
| 2,699,944 | 1/1955 | Keesling . | |
| 2,765,172 | 10/1956 | Zuercher et al. . | |
| 2,972,479 | 2/1961 | Congelli et al. | 473/98 |
| 2,983,510 | 5/1961 | Blewitt, Jr. . | |
| 3,059,925 | 10/1962 | Albrecht | 473/99 |
| 3,068,004 | 12/1962 | Gruss . | |
| 3,068,006 | 12/1962 | Holloway . | |
| 3,098,653 | 7/1963 | Gruss et al. . | |
| 3,132,862 | 5/1964 | Pratt | 473/99 |
| 3,190,650 | 6/1965 | Zuercher . | |
| 3,297,322 | 1/1967 | Ernst et al. . | |
| 3,964,744 | 6/1976 | Sonnenberg | 473/98 |
| 4,151,993 | 5/1979 | Payne et al. . | |
| 4,272,078 | 6/1981 | Vinette . | |
| 5,039,095 | 8/1991 | Buckley . | |
| 5,152,525 | 10/1992 | Brim et al. . | |
| 5,193,804 | 3/1993 | Smit . | |
| 5,292,121 | 3/1994 | Heddon . | |
| 5,372,551 | 12/1994 | McCarthy et al. . | |
| 5,374,222 | 12/1994 | Burtchett . | |
| 5,449,327 | 9/1995 | Heddon . | |

*Primary Examiner*—William M. Pierce

*Attorney, Agent, or Firm*—Allen, Dyer, Doppelt, Milbrath & Gilchrist, P.A.

[57] ABSTRACT

A bowling alley pinsetter includes a conveyor belt forming a partial central portion of a pit surface. Hard plastic panels having a slippery top surface flank the central conveyor. The panels are inclined downward from pit kickbacks toward the conveyor belt for deflecting balls and pins onto the belt. Pins are delivered to a pin elevator by the belt. A ball stop extending transversely across is elevated for passing pins beneath while stopping a bowling ball. A ball sensor detects the ball at the ball stop and initiates a sweeping motion of a ball rake stored proximate one kickback transversely across the pit surface along the ball stop for urging the ball across the pit surface, including the inclined panel, to an opening within one kickback for delivery to an adjacent ball return assembly. The ball rake employs a groove shaft and pawl for converting rotational movement of the shaft to a linear movement of the ball rake. A ball door blocking passage through the opening is lifted during the sweeping action for permitting the ball to be passed through the opening. Upon return of the ball rake to its stored position, the ball door returns to its blocking position. The central conveyor belt is driven by rollers having a groove for receiving a continuous tract extending from an inner surface of the belt contacting the rollers. The track and groove arrangement prevent side to side movement of the belt.

23 Claims, 6 Drawing Sheets

BOWLING ALLEY PINSETTER AND METHOD FOR HANDLING SPENT BALLS AND PINS

BACKGROUND OF INVENTION

1. Field of Invention

The invention relates generally to the game of bowling, and more particularly to handling bowling pins and balls in the bowling alley pit area for speedy delivery of balls back to a player at an approach end of the alley.

2. Background Art

In the game of bowling, it is desirable to return a ball to a bowler as efficiently and quickly as possible. Typically, pinsetter bowling ball return mechanisms are shared between adjacent alleys or lanes. Balls and pins falling into each alley pit is typically such that the removal of the ball out of the pit area is delayed. Further, the problem of keeping pins out of the ball return area and preventing jams persists even in state of the art ball and pit handling equipment. As a result, the return of the ball to the player is delayed, and operation of the alley may have to stop until the jam is manually removed.

It is well known to use carpet conveyor belts within the alley pit area for delivering spent pins swept from the pin deck under a backstop styled cushion and toward the pin elevator where they are lifted for positioning into a pinsetting deck. The cushion is typically positioned above the carpet for permitting a pin, lying on its side, to pass thereunder while blocking the ball. Further, the carpet is typically tilted or slanted at a slight compound angle, inclining the carpet belt to the side and back for using gravity to aid in rolling the ball towards a side opening which accesses a ball return mechanism. Many pit areas include bounce boards under the carpet and vibrating pits to expedite the delivery of the ball to the return mechanism and the pins to the pin elevator. The pinsetters that use the conveyor carpet belt typically include a belt having a width of approximately 57" which spans across the width of the pit area. It is recommended that a conveyor belt be typically three times as long as it is wide for smooth operation. Typical pinsetter carpet conveyor belts range from 80" to 88" in length and 57" in width resulting in tracking problems that are well known to exist in the pinsetter art. The opening is positioned such that a ball rolling to the side of the pit along the cushion backstop will roll toward the opening under the influence of gravity and enter the opening for delivery to the ball return mechanism. Such a system present problems well known in the art and various methods and devices have been used to correct the major problem of unwanted pins as well as the desired ball from entering the ball return area. Paddle mechanisms that permit a pin to pass through the opening and simply push the pin back into the pit area have been used. Some ball doors have been designed to prevent pins from passing through the opening which is blocked by the door. However, pins swept from the pin deck can be trapped in front of the ball as it rolls toward the opening wherein the ball itself pushes the pin through the hole.

By way of example, U.S. Pat. No. 2,600,918 discloses a bowling ball return mechanism which includes a pair of pivotally mounted check gates positioned at adjacent kickbacks of adjoining alleys wherein the gates cooperate with each other for permitting a ball from one alley to force open its gate while preventing the adjoining gate from opening. A bowling ball being ejected from one pit area under the propulsion of a driving belt develops a momentum and thus a force for opening its gate. If its momentum is greater than that of a ball ejected from the adjacent alley, it will push the gate open to a maximum position permitting the it to be directed into a common ball return. The gates are positioned near the ends of two transverse ball return guides of adjoining alleys.

U.S. Pat. No. 2,699,944 discloses a ball return mechanism for use between adjacent bowling alleys also comprising dual gates, one for each alley. A bowling ball delivered to its gate, forces the gate open under the force of its weight against the gate and is delivered into a ball return mechanism. Each gate is pivotal from an arm. The respective arms are connected by springs so that the gates are urged constantly toward their closed positions. The gates deflect pins driven from the alley pin deck. When a gate is moved to an open position by a ball, movement of the adjacent gate is blocked until the ball which is holding the gate open is moved into a ball driving mechanism for return to the bowler.

U.S. Pat. No. 3,297,322 discloses an oscillating paddle positioned between the pit side walls or kickbacks of adjacent alleys for serving both alleys. The kickbacks have openings through which a ball may roll from the pit to a ball lift and return mechanism. The paddle is moved back and forth between the openings in each kickback so that pins entering the opening will not interfere with the ball lift mechanism. If a pin moves into the opening in the kickback when there is no ball ahead of it, the oscillating paddle will push the pin back into the pit so that a pin conveying mechanism within the pit area can deliver the pin to an elevating mechanism for delivery of the pin for pin setting.

Systems using rubber wheels and ball lifting mechanisms occasionally lift a pin into a ball track intended for ball delivery only. Further, such systems inherently deposit handling system oils and dirt from onto the ball, such as wearing rubber, causing further unwanted conditions. Yet other systems include mechanisms for lifting the pit cushion for permitting the ball to pass underneath for accessing a ball handling device.

In a pending U.S. patent application by this inventor, a bowling ball return gate operates in response to a ball tripping a lever for releasing the gate from its closed position for permitting the ball to be delivered to a center ball return shared by adjacent alleys. The gate operates in combination with an oscillating paddle positioned between kickbacks of the adjacent alleys wherein the paddle is moved from opening to adjacent alley opening of each adjacent kickbacks for alternately receiving a ball through the openings from its respective pit area while clearing any pins within the openings. The paddle moves within a T-tube section which is transverse to a longitudinal tube section housing the gate. The paddle is continuously moved between openings of the adjacent alley kickbacks for clearing pins on a continuous basis. The tripping lever holding the gate in its closed position can only be tripped by a ball entering the T-tube longitudinal section.

SUMMARY OF THE INVENTION

In view of the foregoing background, it is therefore an object of the present invention to provide an apparatus and associated method for delivering a spent bowling ball from within a bowling alley pit area to a ball return. It is further an object to deliver the ball to the return efficiently and effectively while preventing fallen pins from entering the ball return. It is yet another object of the invention to provide an mechanically simple and inexpensive mechanism for delivering the ball to the return while permitting the spent pins to efficiently and effectively be delivered to the pin elevator.

This and other objects, advantages and features of the present invention are provided by a bowling alley pinsetter apparatus useful in handling spent balls and pins falling into a pit area of the alley, the apparatus comprising conveyor means positioned within a pit area for delivering balls and pins falling into the pit area rearwardly toward a pin elevator assembly, the conveyor means forming a pit surface central portion, opposing side panels flanking the pit surface central portion, the side panels inclined upwardly from the pit central portion for causing balls and pins positioned on the inclined panels to roll onto the conveyor means, the conveyor means and opposing side panels defining a pit surface, a ball stop extending transversely across the pit area, the ball stop positioned sufficiently above the pit surface for stopping a bowling ball from rolling therepast while passing bowling pins thereunder for delivery to the pin elevator assembly, ball rake means for sweeping the bowling ball transversely across the pit surface, generally parallel to the back stop, for delivery up one inclined panel and through a side wall opening into a ball return assembly, and gate means for blocking passage through the side wall opening, the gate means cooperating with the ball rake means for passing the ball therethrough during the sweeping of the ball across a pit surface. In a preferred embodiment of the invention, the apparatus further comprises sensing means which activates the ball rake means for sweeping a ball sensed proximate the ball stop.

A method aspect of the invention is directed to delivering a bowling ball from a pit area of a bowling alley to a ball return assembly positioned adjacent the pit area. The method comprises the steps of conveying balls and pins falling into a pit central portion rearward toward a pin elevator assembly, flanking the conveying central portion with inclined panels positioned within the pit area, and inclining each panel for rolling balls and pins falling onto the panels onto the central portion for the conveying step, placing a ball stop transversely across the pit area, the ball stop elevated sufficiently for permitting fallen pins to pass thereunder while stopping a ball from passing therepast, the ball stop extending across the pit area and behind a pit side wall opening, sensing a ball positioned against the ball stop, and raking the ball transversely across the pit area generally parallel to the ball stop and through the opening. In a preferred method, steps include blocking the opening for preventing balls and pins from passing therethrough and unblocking the opening in response to the ball raking step.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
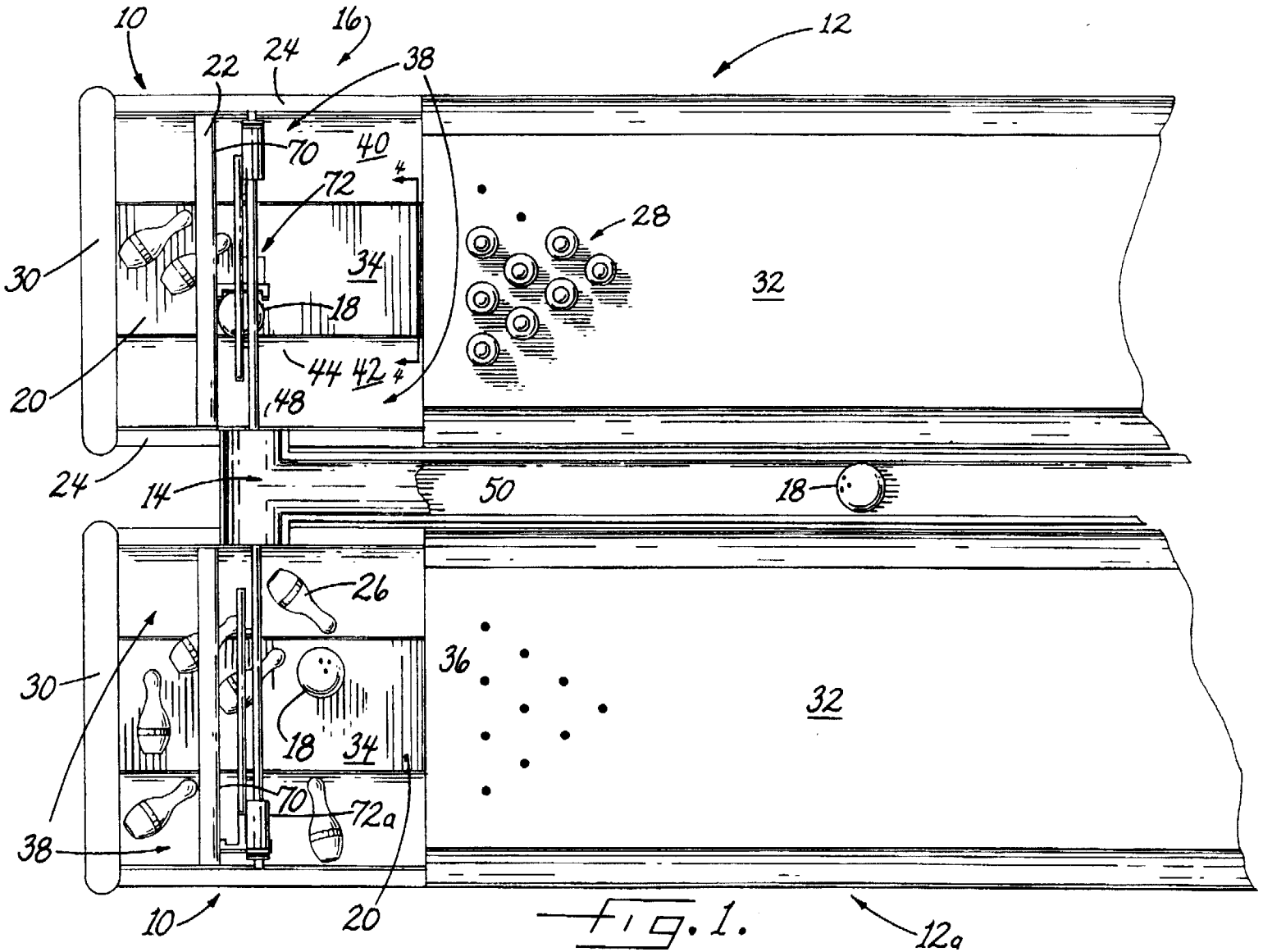
FIG. 1 is a partial plan view of adjacent bowling alleys having a common ball return for delivery of a bowling ball by the apparatus of the present invention from a pit area to the ball return assembly.

Referring now to FIG. 1, an embodiment of the present invention, a bowling alley pinsetter apparatus 10, has been designed for use in a bowling alley 12 having a ball return assembly 14 extending generally from a pit area 16 to an approach area where a bowler receives and rolls a bowling ball 18. Although it is anticipated that the apparatus 10 will be used in a variety of bowling alley pin setting systems, the apparatus 10 is herein described with reference to the bowling alley 12 including a conveyor belt 20 extending beneath a backstop or ball stop 22 as is herein described is transversely mounted across the pit area 16 on an alley frame between pit area side walls referred to as kickbacks 24.

The bowling alley pinsetter apparatus 10 of the present invention includes the conveyor belt 20 positioned within the pit area 16 for delivering balls and pins falling into the pit area 16 rearwardly toward the pin elevator assembly 30. For the present invention, and unlike that well known in the art, the conveyor belt 20 provides a conveying surface 34 which is only contained within a central portion 36 of the pit surface 38 as illustrated again with reference to FIG. 1 and FIG. 2. As illustrated with reference to FIG. 2, opposing side panels 40, 42 flanking the pit surface central portion 36 are inclined upwardly from the pit surface central portion 36 for causing balls 18 and pins 26 that are positioned or deposited onto the inclined panels 40, 42 to roll onto the conveyor belt 20. The conveyor belt 20 and the opposing side panels 40, 42 form the pit surface 38 that currently in the art is fully covered by a conveyor belt. As illustrated, again with reference to FIG. 2, a panel lower edge portion 44 is attached to a frame base portion 46, and a panel upper edge portion 48 is attached to pit kickback 24.

Figure 2:
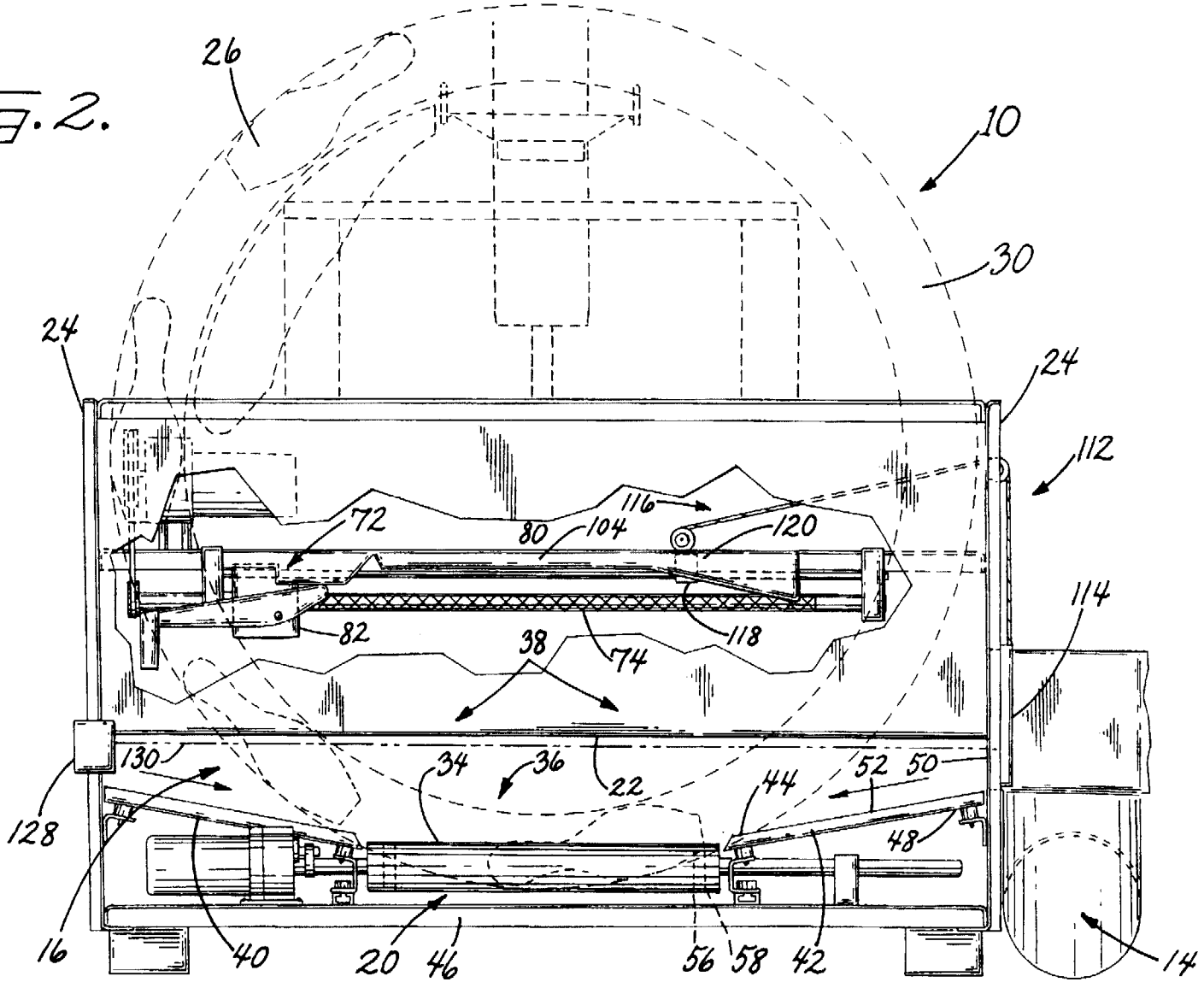
FIG. 2 is a rear elevational view illustrating, with partial cutaway portions, a pinsetter apparatus of the preferred embodiment.

With reference to the panels 40, 42, and again as illustrated in FIG. 2, each panel 40, 42 in one embodiment of the present invention is inclined at an angle of approximately twelve degrees as measured from an imaginary horizontal plane including the belt upper or conveying surface 34. Further, with reference to the panel 42 attached to the kickback 24 having an opening 50 through which the ball 18 is passed for entry into the ball return assembly 14, the panel upper portion 48 is attached so as to place the panel top surface 52 two and five eights inches below the opening lower perimeter portion 54. With such, the chances of a ten pin 26, herein described by way of example, having a radius at its belly of two and one half inches, are greatly reduced should the pin 26 be driven toward the opening 50 by the ball 18 during the well known chaotic activity of the ball 18 and pins 26 within the pit area 16. To provide durability and a slippery surface 52 for the panels 40, 42, the panels 40, 42 are made from a hard plastic material having a highly polished surface for providing low friction and thus permitting easy sliding of pins 26 therefrom toward the belt 20. In a preferred embodiment, the panels 40, 42 are fabricated from a polypropylene plastic or a polyethylene plastic material.

Figure 3:
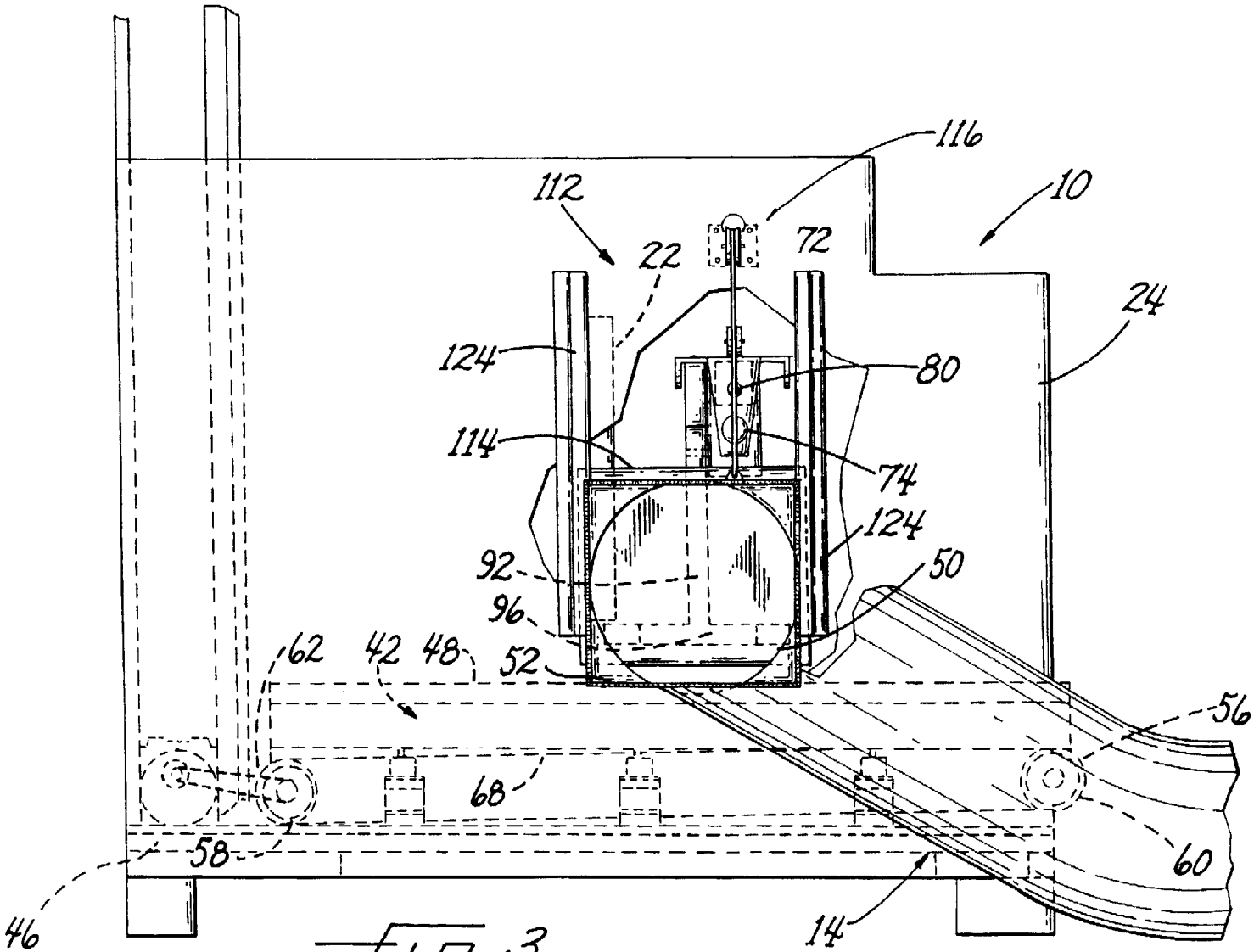
FIG. 3 is a side elevational view of the embodiment of FIG. 2 illustrating use of an adjacent ball return assembly.
Figure 4:
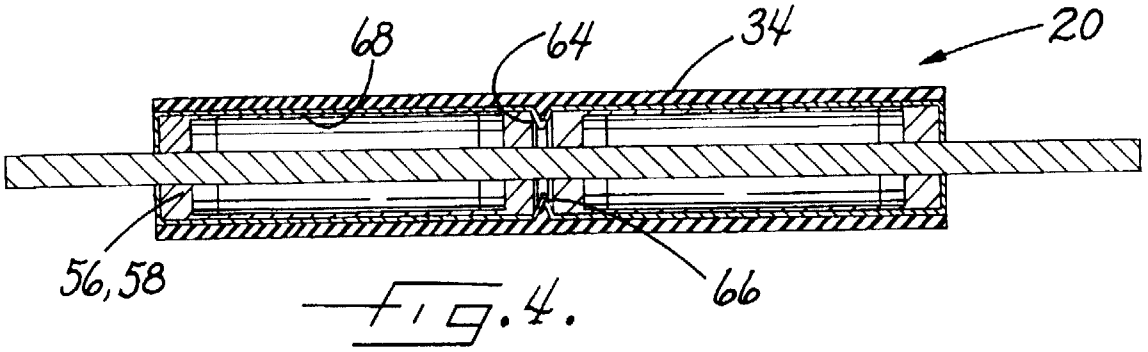
FIG. 4 is a partial cross-sectional view of a roller and conveyor belt of the present invention.

Further, and with reference again to FIG. 2 and to FIGS. 3 and 4, the conveyor belt 20 has a transverse or width dimension of twenty four inches in a pit area 16 that typically has a transverse dimension of fifty seven inches, inside to inside between kickbacks 24. The length of the belt 20 in an alley is typically eighty to eighty eight inches long. Two rollers 56, 58 are positioned for extending the conveyor belt 20 within the pit area 16 from a lane position 60 proximate the alley surface 32 for receiving balls 18 and pins 26 to a rear position 62 proximate the pin elevator assembly 30 for delivering pins 26 to the assembly 30, as illustrated with reference to FIG. 3. Each roller 56, 58 includes a groove 64 similarly placed therein for receiving a continuous belt track 66 formed on a belt inside surface 68. The inside surface 68 communicates with the rollers 56, 58 for driving the belt 20. The continuous track 66 runs within the grooves 64 and thus restricts the potential transverse or side to side movement of the belt 20.

The ball stop 22 extends transversely across the pit area 16 as earlier described with reference to FIG. 1, and is positioned sufficiently above the pit surface 38 for stopping the bowling ball 18 from rolling therepast while permitting the bowling pins 26 to be conveyed thereunder for delivery to the pin elevator assembly 30. It is anticipated that the apparatus 10 herein described will include a ball stop well known in the bowling alley art which includes a cushioned front surface 70 for receiving the ball 18. The ball stop 22 is attached to the opposing kickbacks 24 at its ends.

Figure 5:
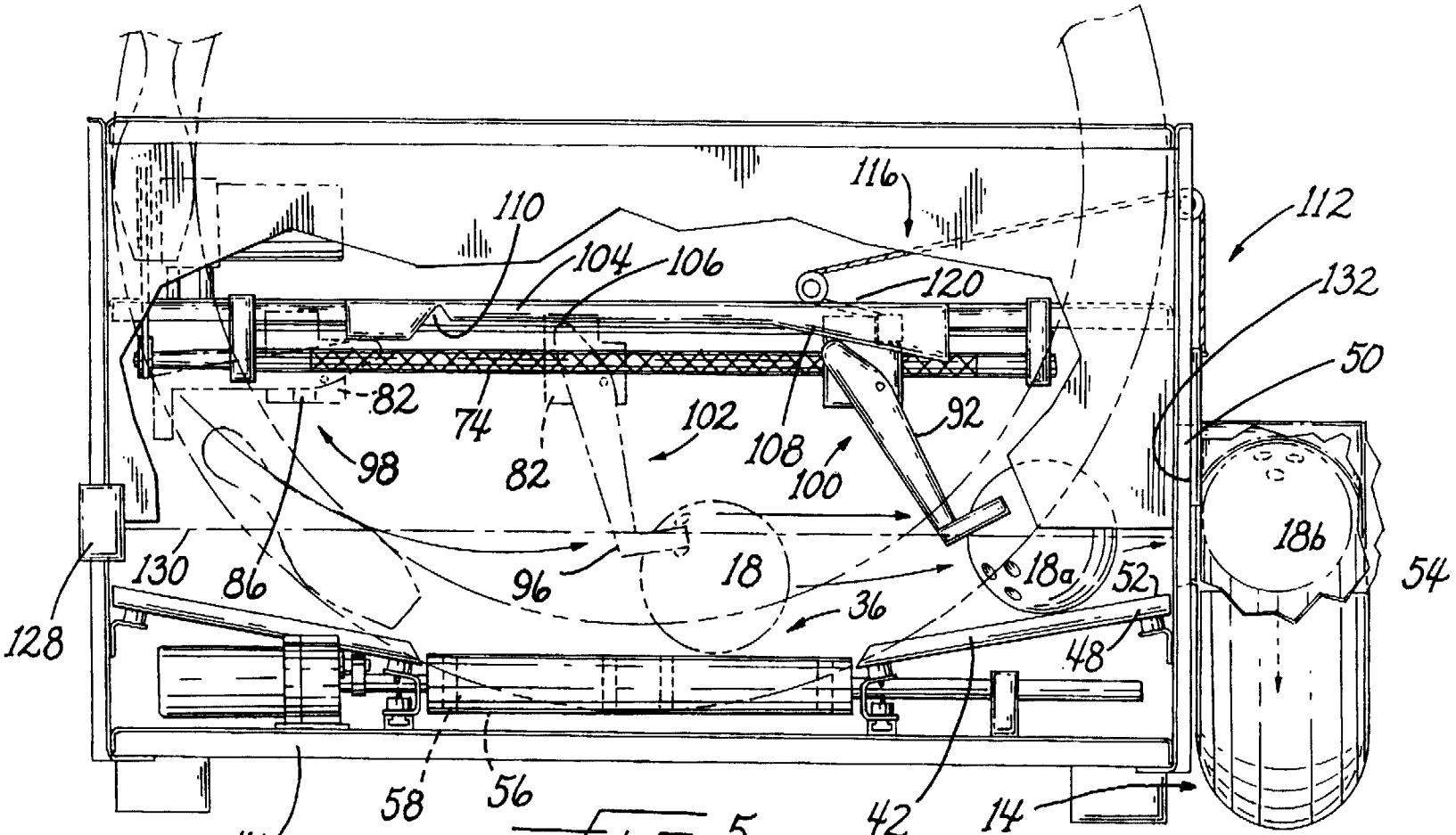
FIG. 5 is a partial real elevational view of the embodiment of FIG. 2, illustrating sequential ball rake positions during phases of sweeping a bowling ball into the ball return assembly.

The apparatus 10 further includes ball rake assembly 72 as illustrated again with reference to FIGS. 3 and 4, and with reference to FIG. 5. The ball rake assembly 72 sweeps or urges the bowling ball 18 transversely across the pit surface 38, generally along and parallel to the back stop 22, for delivery up the inclined panel 42, illustrated with reference to FIG. 5 as ball 18*a*, and through the opening 50 into a ball return assembly 14, illustrated as ball 18*b*.

Figure 6:
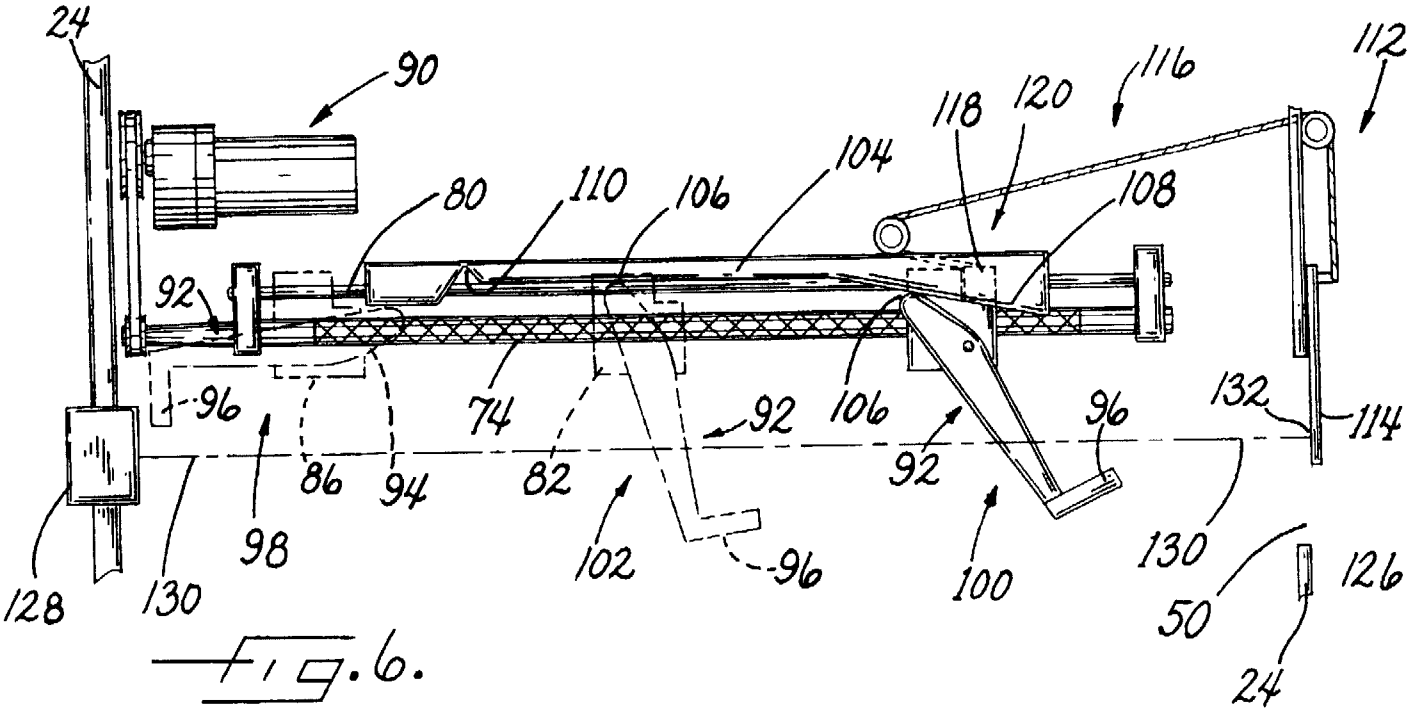
FIG. 6 is a rear elevational of selected elements of the present invention.
Figure 7:
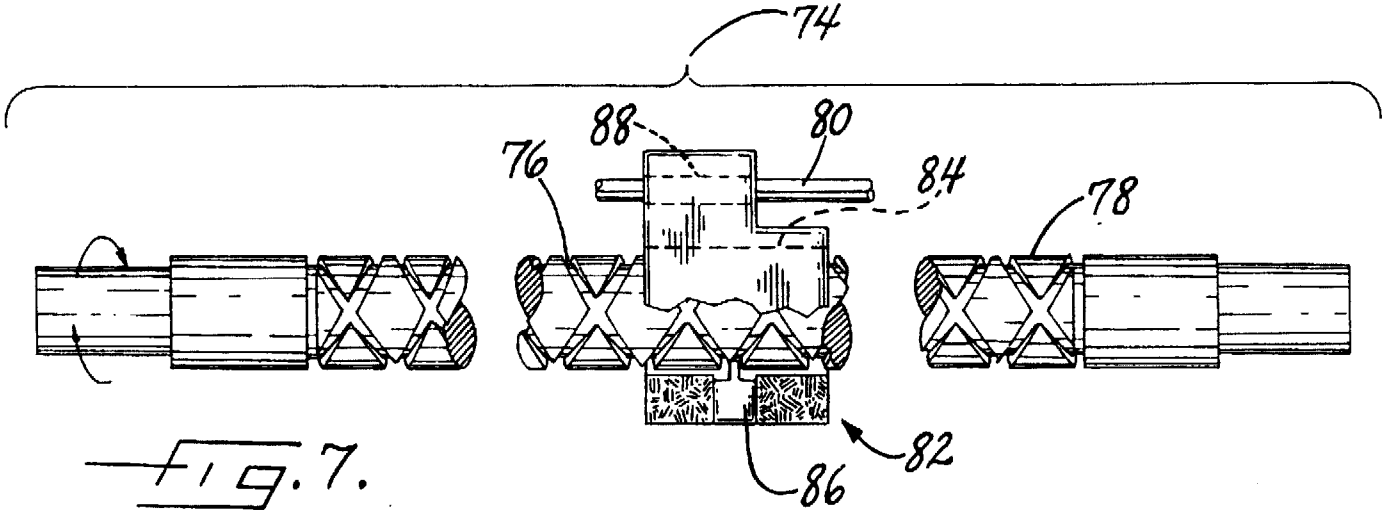
FIG. 7 is a fragmented side view of a ball rake shaft having a continuous groove of constant pitch.

Again with reference to FIG. 5 and to the rake assembly 72, isolated and illustrated with reference to FIG. 6, the ball rake assembly 72 for a preferred embodiment of the present invention, includes a ball rake shaft 74 extending transversely between kickbacks 24 and above the pit surface 38 adjacent and forward of the ball stop 22. The ball rake shaft 74 includes a continuous groove 76 cut into and around the shaft surface 78. The continuous groove 76 has a constant pitch, as illustrated with reference to FIG. 7, for providing a uniform linear movement of sliding means parallel to an axis of the shaft for rotation of the shaft 74. A guide shaft 80 extends parallel to and proximate the rake shaft 74. A slide member 82 includes a rake shaft bore 84 passing therethrough and a groove engaging element 86, acting as a pawl, slidable within the member 82 for communicating with the rake shaft groove 76. The slide member 82 further includes a guide shaft bore 88 passing therethrough and parallel to the rake shaft bore 84 for maintaining the slide member 82 within a fixed orientation during its linear movement across the pit area 16. The guide shaft bore 88 closely receives the guide shaft 80 therethrough, thus maintaining the slide member 82 within a fixed, generally vertical plane including the member 82. The groove engaging element 86 tracks within or follows the rake shaft groove 76 during rotation of the rake shaft 74 for providing the linear movement of the slide member 82 transversely across the pit area 16 as the rake shaft 74 is rotate by a drive motor assembly 90 including a drive motor, pulley and belt typically used. A ball rake member 92 having a proximal end 94 pivotally attached to the slide member 82 and a distal end 96 for urging the ball 18 toward the opening 50 as the ball rake member 92 moves from a first stored position 98 proximate one pit kickback 24 to a second position 100 proximate an opposing kickback 24 for delivering the ball 18*a* through the opening 50 as earlier described and as described with reference to FIGS. 5 and 6. In operation, the ball rake member 92 moves from the stored position 98 through intermediate positions 102 where it contacts the ball 18 for movement of the ball 18 along the pit surface central portion 36, up the inclined panel 42, as illustrated with reference to FIG. 5, for delivering the ball 18*a* through the opening 50. An elongate cam 104 provides an orientation of the ball rake member 92 through the action of the member 92 pivoting about the slide member 82 while an member edge portion 106 biases against the cam 104 under a gravitational pull from the member distal end 96. The cam 104 includes surface contours for providing a prescribed rotational movement of the ball rake member 92 including a wedge contour 108 for providing an added lift to the ball 18*a* when urging it into the opening 50, as well as a dip 110 for swinging the rake member 92 into its stored position 98 after having made the traversal across the pit area 16, again as illustrated with reference to FIGS. 5 and 6. The drive motor assembly 90 as described, is operatively connected to the rake shaft 74 for providing rotation of the shaft 74 and thus the movement of the ball rake member 92 through its various positions (98, 102, 100, 102, and back to 98) until energized for another ball raking cycle.

Again with reference to FIGS. 2, 3 and 5, the opening 50 is blocked using a gate assembly 112 which blocks passage of balls 18 and pins 26 through the kickback opening 50 until the ball rake assembly 72 is in the position 100 means for passing the ball 18*a* therethrough during the sweeping of the ball 18 across the pit surface 37. The gate assembly 112 includes a door 114 connected through a cable and pulley arrangement 116 to a door slide element 118 which is contacted by the slide member 82 as the slide member 82 approaches its second position 100 as earlier described. Contact between the door slide element 118 and slide member 82 continues as the member 82 delivers the ball 18*a* into the opening 50 wherein the pulley and cable arrangement 116 a fully unblocked opening 50 with the slide element at a fully displaced position 120, as illustrated with reference to FIGS. 5 and 6. As the slide member 82 is returned toward its storage position 98, the slide member 82 moves back along the guide shaft 80 and returns the slide element 118 to its rest position 120 as illustrated again with reference to FIG. 2. The door 114 slides up and down within slide rails 124 attached to an outside surface portion 126 of the kickback 24 for cooperating in the blocking and unblocking of the opening 50.

A ball sensing device 128 includes a beam 130 emitted from the device 128 toward the door 114 for return to the device 128 after reflecting from a door inside surface 132. The sensing device 128 is electrically connected to the ball rake shaft drive motor assembly 90 and activates the ball rake assembly 72 for sweeping a ball 18 sensed proximate the ball stop 22. When used in conjunction with cooperating adjacent alley 12*a*, as illustrated with reference to FIG. 1, for sharing the ball return assembly 14, each apparatus 10 for each alley 12, 12*a*, provides a signal for activating the respective ball rake assemblies 72, 72*a* and permits the assemblies 72, 72*a* to operate on a first come-first serve basis. In this way, only one ball 18*b* at a time will be entering the ball return assembly 14 from any given alley 12, 12*a*.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

What is claimed is:

1. A bowling ball and pin handling apparatus in combination with a pit area including an elevator assembly for removing pins from the pit area and opposing side walls with a side wall opening for receiving a bowling ball therethrough, the bowling ball and pin handling apparatus useful in handling spent balls and pins falling into the pit area, the apparatus comprising:

conveyor means positioned within the pit area for receiving balls and pins falling into the pit area and delivering balls and pins rearwardly toward a pin elevator assembly;

opposing side panels positioned within the pit area and flanking the conveyor means, each of the side panels inclined upwardly from the conveyor means for causing balls and pins deposited onto the inclined panels to roll onto the conveyor means, the conveyor means and opposing side panels defining a pit surface;

a ball stop extending transversely across the pit surface and spaced sufficiently above the pit surface for stopping a bowling ball from rolling therepast while permitting bowling pins to pass thereunder for delivery to a pin elevator assembly;

ball rake means carried above the pit surface for movement from a stored position above the pit surface to a ball engaging position for urging a bowling ball transversely across the pit surface for delivery up one inclined side panel and through a side wall opening; and gate means for blocking passage of balls and pins through the side wall opening, the gate means cooperating with the ball rake means for passing a ball therethrough.

2. A pinsetter apparatus according to claim 1, further comprising ball sensing means for sensing a bowling ball, the ball sensing means communicating with the ball rake means for activating the ball rake means when a ball is positioned proximate the ball stop.

3. A pinsetter apparatus according to claim 1, wherein the conveyor means comprises:

at least two rollers positioned for extending a conveyor belt within the pit central portion from a position proximate the lane for receiving balls and pins to a position proximate the pin elevator assembly for delivering pins into the assembly, each roller having a groove similarly placed therein for receiving a belt track; and a conveyor belt having an outside surface and an inside surface, the outside surface forming the pit surface central portion, the inside surface communicating with the rollers, the inside surface having a track affixed thereto for communicating with the groove in each roller for limiting transverse movement of the conveyor belt.

4. A pinsetter apparatus according to claim 1, wherein the ball rake means comprises:

a ball rake shaft extending transversely above the pit surface, the ball rake shaft having a continuous groove along a surface of the shaft, the groove having a pitch for providing a continuous linear movement of a slide member along the shaft during rotation of the shaft;

a guide shaft extending generally parallel to and proximate the ball rake shaft;

a slide member slidably engaged with the ball rake shaft the slide member having a first bore passing therethrough and a groove engaging element slidable within the slide member for engaging the rake shaft groove, the slide member having a second bore passing therethrough generally parallel to the first bore, the second bore receiving the guide shaft for maintaining the slide member within a fixed plane, the groove engaging element tracking within the rake shaft groove during rotation of the rake shaft for providing a linear movement of the slide member transversely across the pit area as the rake shaft is rotated;

a ball rake member having a proximal end pivotally attached to the slide member, the ball rake member having a distal end for urging a ball toward the side wall opening as the ball rake member moves from a first position proximate one pit side wall to a second position proximate the opposing side wall for delivering a ball through the side wall opening; and drive means operatively connected with the rake shaft for providing rotation of the shaft for movement of the ball rake member from the first position to the second position and back to the first position during a ball raking cycle.

5. A pinsetter apparatus according to claim 1, wherein the gate means comprises:

a door operable with the side wall opening, the door slidable from a first position blocking passage through the side wall opening to a second position providing clear passage of a ball through the side wall opening; and cable and pulley means operable between the door and the ball rake means for moving the door from the first position to the second position of the door in response to a ball being urged toward the side wall opening by the ball rake means.

6. A bowling ball and pin handling apparatus in combination with a pit area having an elevator assembly for removing pins from the pit area, opposing side walls and a side wall opening within a side wall for passage of a bowling ball therethrough, the apparatus comprising:

conveyor means positioned within the pit area for receiving balls and pins falling into the pit area and delivering balls and pins rearwardly toward a pin elevator assembly;

at lease one side panel positioned within the pit area and flanking the conveyor means, the at least one side panel inclined upwardly from the conveyor means for causing balls and pins deposited onto the inclined panel to roll onto the conveyor means, the conveyor means and the at lease one side panel forming a pit surface;

a ball stop extending transversely across the pit area surface, the ball stop positioned sufficiently above the pit surface for stopping a bowling ball from rolling therepast while permitting bowling pins to pass thereunder for delivery to a pin elevator assembly; and ball rake means carried above the pit area surface for movement from a stored position above the pit surface to a ball engaging position for urging a bowling ball transversely across the pit surface for delivery up the inclined at least one side panel and through a side wall opening.

7. A pinsetter apparatus according to claim 6, further comprising a second side panel opposing the at least one side panel, the side panels flanking the conveyor means, the second side panel inclined for causing the balls and pins deposited thereon to roll onto the conveyor means, the conveyor means and flanking side panels forming the pit area surface.

8. A pinsetter apparatus according to claim 6, further comprising gate means for blocking passage through the side wall opening, the gate means cooperating with the ball rake means for permitting passage of a ball through the side wall opening.

9. A pinsetter apparatus according to claim 8, wherein the gate means comprises a door slidable from a first position blocking passage through the side wall opening to a second position providing clear passage of a ball through the side wall opening, the door operatively connected to the ball rake means for moving the door from the first position to the second position of the door in response to a ball being urged toward the side wall opening.

10. A pinsetter apparatus according to claim 6, further comprising ball sensing means for sensing a bowling ball, the ball sensing means communicating with the ball rake means for activating the ball rake means when a ball is positioned proximate the ball stop.

11. A pinsetter apparatus according to claim 6, wherein the conveyor means comprises:

roller means for extending a conveyor belt longitudinally within the pit area for delivering pins falling into the pit area to the pin elevator assembly, the roller means having guide means for receiving a conveyor belt track; and a conveyor belt having an outside surface for conveying pins and an inside surface for communicating with the roller means, the inside surface having a track affixed thereto for communicating with the guide means for limiting transverse movement of the conveyor belt.

12. A pinsetter apparatus according to claim 6, wherein the ball rake means comprises:

a ball rake shaft for extending transversely above the pit surface, the ball rake shaft having a continuous groove along a surface of the shaft, the groove having a pitch for providing a continuous linear movement of slide means along the ball rake shaft during rotation of the shaft;

slide means for slidably engaging the ball rake shaft and for providing a linear movement of the slide means transversely across the pit area as the rake shaft is rotated;

a ball rake member engageable with the slide means for urging a ball toward the side wall opening as the ball rake means moves from the stored position to the ball engaging position; and drive means operatively connected with the rake shaft for providing rotation of the shaft.

13. A bowling ball and pin handling apparatus in combination with a pit area having an elevator assembly for removing pins from the pit area, opposing side walls and a side wall opening within a side wall for passage of a bowling ball therethrough, the apparatus comprising:

a conveyor operable within the pit area for delivering spent balls and pins rearward toward a pin elevator assembly;

a ball stop positioned for stopping spent bowling balls from rolling therepast while permitting spent pins to pass for engaging a pin elevator assembly;

ball rake means carried above the conveyor for movement from a stored position above the pit surface to a ball engaging position for urging a bowling ball transversely across the pit surface for delivery through the side wall opening; and gate means for blocking passage of spent balls and pins through the side wall opening, the gate means cooperating with the ball rake means for passing a ball through the side wall opening.

14. A pinsetter apparatus according to claim 13, wherein the ball rake means comprises:

a ball rake shaft extending transversely above the pit surface, the ball rake shaft having a continuous groove along a surface of the shaft for providing a continuous linear movement of a slide member along the shaft during rotation of the shaft:

a guide shaft extending generally parallel to and proximate the ball rake shaft;

a slide member slidably engaged with the ball rake shaft, the slide member having a first bore passing therethrough and a groove engaging element slidable within the slide member for engaging the rake shaft groove, the slide member having a second bore passing therethrough generally parallel to the first bore, the second bore receiving the guide shaft for maintaining the slide member within a fixed plane passing through the member, the groove engaging element tracking within the rake shaft groove during rotation of the rake shaft for providing a linear movement of the slide member transversely across the pit area as the rake shaft is rotated;

a ball rake member having a proximal end pivotally attached to the slide member, the ball rake member further having a distal end for urging a ball toward the side wall opening as the ball rake member moves from a first position proximate one pit side wall to a second position proximate the opposing side wall for delivering a ball through the side wall opening; and drive means operatively connected with the rake shaft for providing rotation of the shaft for movement of the ball rake member from the first position to the second position and back to the first position during a ball raking cycle.

15. A pinsetter apparatus according to claim 13, wherein the gate means comprises:

a door slidable from a first position for blocking passage through the side wall opening to a second position for providing clear passage of a ball through the side wall opening; and cable and pulley means operable between the door and the ball rake means for moving the door from the first position to the second position of the door in response to a ball being urged toward the side wall opening by the ball rake means.

16. A pinsetter apparatus according to claim 13, further comprising ball sensing means for detecting a bowling ball positioned proximate the ball stop, the ball sensing means operable with the ball rake means for activating the ball rake means for urging a ball transversely across the pit surface to the side wall opening.

17. A pinsetter apparatus according to claim 13, further comprising:

the conveyor forming a pit surface central portion; and opposing side panels flanking the pit surface central portion, the side panels inclined upwardly from the pit surface central p each ofortion for causing bowling balls and pins falling onto the inclined side panels to roll onto the conveyor.

18. A pinsetter apparatus according to claim 17, wherein the conveyor comprises:

a roller having guide means for receiving a conveyor belt track; and a conveyor belt track affixed along an inside surface of the conveyor for communicating with the guide means for limiting transverse movement of the conveyor.

19. A method for handling a spent bowling ball and pin falling into a pit area of a bowling alley and for delivering spent bowling balls from the pit area to a side wall opening within a side wall of the pit area while permitting spent pins to be conveyed to a pin elevator assembly, the method comprising the steps of:

providing a pit surface having a central portion for conveying spent bowling balls and pins falling into a pit area central portion rearward toward a pin elevator assembly;

flanking the pit area central portion with inclined panels positioned within the pit area, and inclining each panel for rolling spent balls and pins falling onto the panels to the central portion;

placing a ball stop transversely across the pit area, the ball stop elevated sufficiently above a pit surface for permitting spent pins to pass thereunder while stopping spent balls from passing therepast;

blocking the side wall opening for preventing spent balls and pins from passing therethrough;

conveying spent balls and pins falling into the pit central portion rearward toward the pin elevator assembly sensing a ball positioned against the ball stop;

raking a ball transversely across the pit area generally parallel to the ball stop;

unblocking the sidewall opening in response to the ball raking step; and continuing the raking step for urging a ball up the inclined panel and outward of the pit area through the side wall opening.

20. A method according to claim 19, wherein the conveying step comprises the steps of:

providing a conveyor belt having a width dimension extending across the pit area central portion, the conveyor belt having a continuous track extending along an inside surface of the belt;

providing rollers having grooves therein for receiving the track and limiting transverse movement of the belt; and driving the belt over rollers.

21. A method according to claim 19, wherein the ball raking step includes the steps of:

extending a ball rake shaft transversely above the pit surface, the ball rake shaft having a continuous groove along a surface of the shaft for providing a continuous linear movement of the ball across the pit area during rotation of the ball rake shaft;

passing the shaft through a slide member having a groove engaging element slidable within the member for communicating with the rake shaft groove, the groove engaging element tracking within the rake shaft groove during rotation of the rake shaft for providing a linear movement of the slide member transversely across the pit area as the rake shaft is rotated;

attaching a ball rake member to the slide member for urging the ball toward the opening as the ball rake member moves from a first position proximate one pit side wall to a second position proximate an opposing side wall for delivering the ball through the side wall opening; and rotating the shaft for moving the ball rake member from the first position to the second position and back to the first position during a ball raking cycle.

22. A method for handling spent bowling balls and pins falling into a pit area of a bowling alley and for delivering spent bowling balls from the pit area through a side wall opening within a side wall of the pit area, the method comprising the steps of:

extending a ball stop transversely across the pit area, the ball stop elevated sufficiently above a surface of the pit area for permitting spent pins to pass thereunder while stopping spent balls at the ball stop;

blocking the side wall opening for preventing spent balls and pins from passing therethrough;

conveying spent balls and pins within the pit area rearward toward the ball stop;

sensing a ball positioned against the ball stop;

raking a ball transversely across the pit area generally parallel to the ball stop;

unblocking the opening in response to the ball raking step; and continuing the raking step for urging a ball through the side wall opening.

23. A method according to claim 22, wherein the ball raking step includes the steps of:

extending a ball rake shaft transversely above the pit surface, the ball rake shaft having a continuous groove along a surface of the shaft for providing a continuous linear movement of the ball across the pit area during rotation of the ball rake shaft;

passing the shaft through a slide member having a groove engaging element slidable within the slide member for communicating with the rake shaft groove, the groove engaging element tracking within the rake shaft groove during rotation of the rake shaft for providing a linear movement of the slide member transversely across the pit area as the rake shaft is rotated;

attaching a ball rake member to the slide member for urging the ball toward the opening as the ball rake member moves from a first position proximate one pit side wall to a second position proximate an opposing side wall for delivering the ball through the side wall opening; and rotating the shaft for moving the ball rake member from the first position to the second position and back to the first position during a ball raking cycle.

* * * * *